US007407321B1

(12) United States Patent
Renfro

(10) Patent No.: US 7,407,321 B1
(45) Date of Patent: Aug. 5, 2008

(54) METHOD FOR MIXING COLORANT WITH A VISCOUS MATERIAL

(76) Inventor: Charles K. Renfro, 146 Volunteer Dr., Elizabethton, TN (US) 37643

( * ) Notice: Subject to any disclaimer, the term of this patent is extended or adjusted under 35 U.S.C. 154(b) by 222 days.

(21) Appl. No.: 11/139,174

(22) Filed: May 28, 2005

Related U.S. Application Data

(63) Continuation-in-part of application No. 10/293,850, filed on Nov. 14, 2002, now Pat. No. 6,910,799, which is a continuation-in-part of application No. 09/563, 465, filed on May 2, 2000, now abandoned, and a continuation-in-part of application No. 10/115,330, filed on Apr. 2, 2002, now Pat. No. 7,070,318.

(51) Int. Cl.
*B01F 3/10* (2006.01)

(52) U.S. Cl. ..... 366/256; 366/251

(58) Field of Classification Search ..... 366/247, 366/249–252, 255, 256, 289, 331–333, 605
See application file for complete search history.

(56) References Cited

U.S. PATENT DOCUMENTS 2,831,606 A * 4/1958 Alters ..... 222/1
3,514,080 A * 5/1970 Price et al. ..... 366/169.1
3,606,094 A * 9/1971 Mills et al. ..... 222/145.6
3,858,853 A * 1/1975 Rausch et al. ..... 366/279
4,090,612 A * 5/1978 Lostutter ..... 211/13.1
4,735,509 A * 4/1988 Rausch ..... 366/333
5,044,758 A * 9/1991 Kurtz ..... 366/77
6,302,575 B1 * 10/2001 Anderson et al. ..... 366/349
6,910,799 B2 * 6/2005 Renfro ..... 366/169.1
7,070,318 B2 * 7/2006 Renfro ..... 366/143
2002/0036952 A1 * 3/2002 Anderson et al. ..... 366/348

* cited by examiner

*Primary Examiner*—David L Sorkin
(74) *Attorney, Agent, or Firm*—Luedeka, Neely & Graham, P.C.

(57) ABSTRACT

A mixing apparatus having a blade mixer affixed to the end of a mixer shaft which is rotatably or non-rotatably, but slidably mounted thru a mixer seal member which is adapted to be brought into sealing engagement with the open filler end of a retail tube of viscous caulking compound, wherein the shaft and mixer are adapted to be reciprocated thru the viscous compound contained in the tube substantially the entire length of the tube to rapidly and intimately mix the compound with colorant injected thereinto directly in the retail tube.

3 Claims, 6 Drawing Sheets

METHOD FOR MIXING COLORANT WITH A VISCOUS MATERIAL

The present disclosure is a CIP of U.S. Pat. Appl. Ser. No. 10/293,850, entitled "Mixing Apparatus and Method," filed on Nov. 14, 2002, now U.S. Pat. No. 6,910,799, which is a CIP of U.S. Pat. Appl. Ser. No. 09/563,465 entitled "Mixing Apparatus and Method, " filed on May 2, 2000, now abandoned, and which is a CIP of U.S. Pat. Appl. Ser. No. 10/115,330 entitled "Mixing Apparatus and Method," filed on Apr. 2, 2002, now U.S. Pat. No. 7,070,318, which is a CIP of U.S. Pat. Appl. Ser. No. 09/563,465 entitled "Mixing Apparatus and Method," filed May 2, 2000, now abandoned; and is a CIP of U.S. Pat. Appl. Ser. No. 10/115,330entitled "Mixing Apparatus and Method, " filed on Apr. 2, 2002, now U.S. Pat. No. 7,070,318, which is a CIP of U.S. Pat. Appl. Ser. No. 09/563,465 entitled "Mixing Apparatus and Method," filed on May 2, 2000, now abandoned.

BACKGROUND OF THE INVENTION

1. Field

This invention concerns a method and apparatus for mixing any of a wide variety of liquid or particulate materials such as colorant, e.g., a small amount, e.g., 1-10 cc. of the paint the color of which is to be imparted to caulking material contained in a conventional tube, pigment or organic dye, sand, grout; catalyst for two part caulking, or adhesive, or the like preferably in solution or suspension form, into viscous work material, particularly any of a variety of chemically composed base materials of caulking or sealing compound which may already be colored, or clear or white, and which may be used for caulking any structures, wherein the structural components of the apparatus are of unique but simple design and are adapted to accomplish the mixing very rapidly and directly within the work material retail container, i.e., in-situ in an off-the-shelf caulking tube, if so desired.

The word "caulk" as used herein encompasses air drying as well as catalyst curing sealant, adhesive beading and bordering, or insulating caulk or grout, or the like material, including polyurethane construction adhesive, acrylic/silicone the same color as the room. Where the paint is of a light shade in particular, it may be difficult to cover the material completely without multiple paint coats. Also, it is often necessary to do some additional caulking after the final coat of paint has been applied. In that event, the white caulking has to be painted over as the final step. Consequently, some paint dealers have undertaken to mix colorant into the caulking material by hand for certain customers, but considerable time and effort is involved and often results in inferior mixing and considerable clean up time.

The present invention provides a quick, effective, convenient and cleaner method and apparatus for substantially automatically performing the mixing operation.

2. Prior Art

Applicant is unaware of any prior apparatus or method of the type disclosed and claimed herein which is designed to mix colorant directly into caulking compound or the like contained in its retail tube.

SUMMARY OF THE INVENTION

The present invention, in one of its preferred embodiments comprises a mixer head means having a mixer shaft rotatably or non-rotatably mounted axially therethrough and having a mixing impeller or blade means affixed to a distal end thereof, a proximal end of said shaft being adapted for engagement with a power source for reciprocating said shaft and impeller means axially, said head means having a first annular sealing surface adapted for making a sealing connection to a second annular sealing surface on an open filler end portion of a tube of viscous caulking compound or the like whereby the combination of said head means and tube is completely portable and independent of other structure, and wherein said shaft with said mixing impeller or blade means is adapted to be reciprocated thru the viscous compound contained in the tube substantially the entire length of the tube to rapidly and intimately mix the compound with colorant or other additive material placed in the tube.

In certain preferred embodiments:

(a) the blade means is provided at its periphery with a wiping surface adapted to rotatably and longitudinally slide against or in close proximity to the inner surface of the tube whereby no significant amount of unmixed compound or colorant remains;

(b) a colorant supply means is provided to inject the colorant into the compound during reciprocation of the shaft and blade means thru the compound;

(c) the supply means of (b) above comprises passage means extending longitudinally thru the shaft whereby colorant can be either pressure injected or gravity fed at a desired rate therethrough into the compound either before or during rotation and/or longitudinal mixing movement of the shaft thru the compound;

(d) the shaft with mixer blade means is rotatably mounted and supported on rotative power means in a longitudinally stationary position wherein mixer head means is provided for holding the tube filler end and wherein linear power means is provided for longitudinally reciprocating said head means and tube relative to the shaft and mixer blade means;

(e) power means is provided for selectively reversing rotation of the shaft and blade means during the mixing operation to afford maximum mixing turbulence to the compound;

(f) said head means includes rotative power means connected to said proximal end of said shaft for rotating said shaft; and (g) said head means is provided with structure for connecting it to an apparatus which can reciprocate the head and tube relative to said shaft and impeller.

The present mixing method in one preferred embodiment employing a retail, off-the-shelf tube of caulking material wherein the tube has a puncturably sealed dispenser end section, a filler end section having surface portions defining a fill opening into the tube, a thrust cap sealingly, slidably mounted in said filler end section, and further employing a mixer head means adapted to seal against said surface portions of said filler end section during the mixing operation, wherein said head means has mixer shaft means rotatably and axially slidably mounted therethrough, and wherein a mixer impeller means is fixed to a distal end of said mixer shaft means for rotation and/or axial movement therewith, said method comprising the steps of (a) removing said thrust cap from said tube, (b) adding additive into said tube, (c) connecting said head means to and sealingly against said surface portions of said filler end section to seal said fill opening with said blade means inside of said tube and to provide a portable independent combination of said head means and tube, (d) starting rotation and/or relative reciprocation of said mixer shaft means within said tube and continuing the rotation and/or reciprocation for a desired mixing period, (e) removing said tube and the colored compound therein from said shaft, impeller means and head means, and (f) replacing said thrust cap in said filler end section to retain the mixed compound and additive in said tube until use.

BRIEF DESCRIPTION OF THE DRAWINGS

The invention will be further understood from the following description and drawings herein wherein the structures depicted are not drawn to scale or actual relative proportions and wherein portions thereof are cross-sectioned or broken away for clarity, wherein.

DETAILED DESCRIPTION OF THE DRAWINGS

Figure 1:
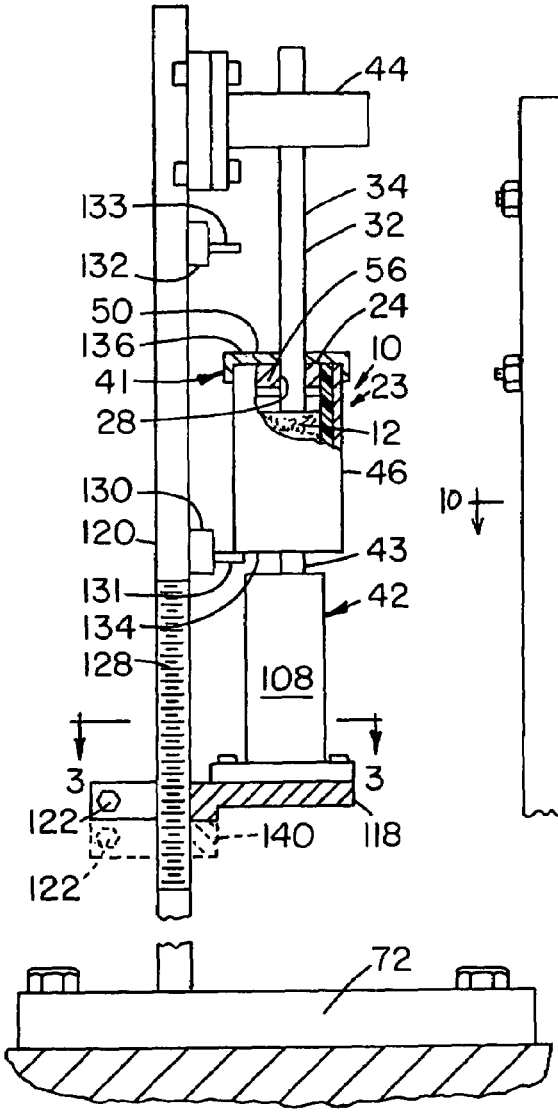
FIG. 1 is a partially sectioned schematic view of an overall mixer apparatus including a fluid, air or hydraulic cylinder for reciprocating the mixing head means and caulking tube.

Referring to the drawings and with particular reference to the claims hereof, the present apparatus in one preferred form and generally designated 10 is well adapted for mixing liquid, solid or suspension colorant or other material with viscous work material 12 such as caulk which is contained in a reservoir 14 of an elongated tube 16, typically of plastic, between a puncturably sealed dispensing end 18 and a filler end 20 normally sealed by a thrust cap seal such as 17. The reservoir is provided by a cylindrical inner surface 22 of the tube and has a substantially uniform diameter throughout its length. One typical caulk tube size is approximately 1⅞ O.D. and 8½ in., long.

With reference to all of the embodiments shown herein the apparatus in its generic sense comprises mixer head means of metal or plastic material and generally designated 23 having a tube end seal means generally designated 24 adapted to be brought into static engagement by pressure cap means generally designated 41 with wall portions such as the top rim 26 or the upper portions 27 of the interior or outer surfaces of the filler end 20 of the tube to prevent leakage of the work material from the tube during the mixing operation. Bore means 28 is formed thru the seal means 24 substantially on a longitudinal axis 30 of the tube, and an elongated mixer shaft means 32 is mounted thru 28 for both rotational and axial motion with respect to the seal means 24 and tube 16. This shaft means has a proximal end 34 lying axially outwardly of the seal means and has a distal end 36 lying within the reservoir 14. Mixer impeller means 38 is mounted on said distal end and has a periphery 40 adapted to lie closely adjacent to or in sliding contact with cylindrical inner surface 22 of the tube. The above seal means 24, bore means 28, shaft means 32, impeller means 38 and pressure cap means 41 constitute the basic structure of the head means 23. Power means such as 42 is provided for axially moving, in a relative sense, shaft means 32 and impeller 38 substantially completely thru the reservoir of material in a reciprocating manner, and power means such as 44 is provided for rotating the shaft 32 and impeller 38 as they are being moved axially thru the material.

Figure 2:
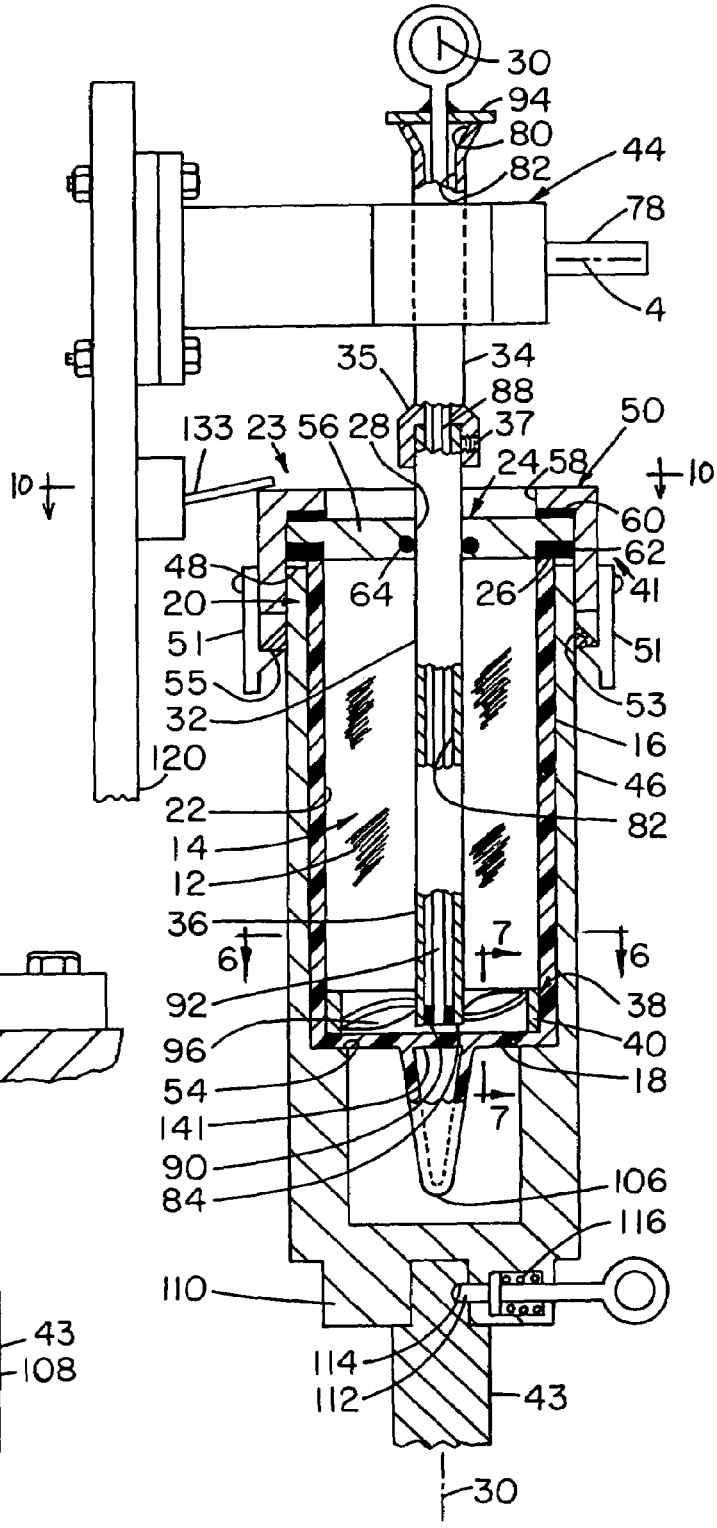
FIG. 2 is a longitudinal partial cross-sectional view of one preferred type of mixing head means for carrying out the present mixing operation wherein the head means and tube are in the up position and wherein the head means has just tripped the top limit switch to reverse the hydraulic cylinder stroke.

In the embodiment shown in FIGS. 1 and 2 the pressure cap means 41 comprises a cylindrical holder section 46 and a pressure cap section 50. The caulking tube is dropped, dispensing end 18 first, with a loose fit between the holder section and tube to allow easy removal of the tube after mixing. In the embodiment of FIG. 2, the top rim 26 of the tube preferably extends slightly above the top rim 48 of the holder section whereby when a pressure cap section 50 is forced down onto the seal means 24, the seal means will seal the tube filler end 20 and said cap section will clamp the ends 20 and 18 of the tube between the seal 24 and a circular ledge 54 on the holder section interior wall. This clamping will prevent rotation of the tube during the mixing operation wherein rotation of the mixer impeller and compound tends to drag the tube into rotation.

Figure 11:
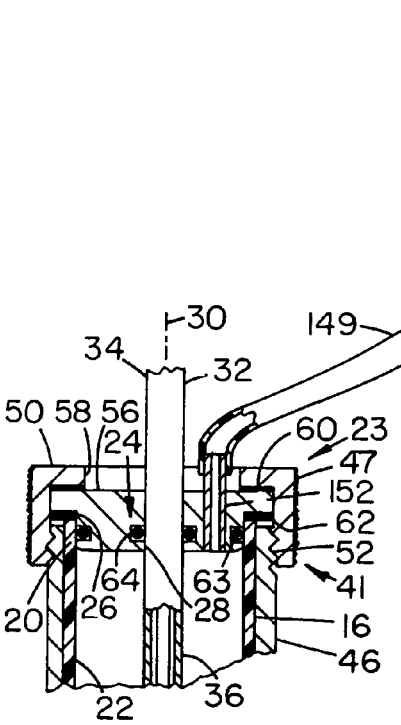
FIG. 11 is a view of the mixer head means on the tube filler end as in FIG. 2 showing a hand held variation of the colorant injection means.

In the embodiment of FIG. 11 a special type of tube end seal means is shown wherein the seal body 56 thereof can be glass, preferably tempered and tough, or clear plastic, and the pressure cap section 50 is formed with a large opening 58 such as to afford a visual inspection of the progress and extent of the colorant mixing operation. An annular cushion 60 of elastomeric material, preferably silicone lubricated, is provided, but not essential, and which, in cooperation with annular elastomeric seal ring 62 cushions the seal body 56. It is noted that where glass is not used, cushion 60 still has utility in providing a slippery surface to facilitate tightening of cap section 50 where threads are employed as shown in FIG. 11, without tending to rotate the seal body 56 and seal ring 62. One or more additional seals such as O-rings 63 may be mounted on 56 if needed.

Shaft means 32 is rotatably mounted thru seal body 56 in all of the embodiments shown, which body is preferably provided with a mixer shaft seal 64 such as an O-ring or other annular ring type seal of composition and configuration which affords an axially sliding seal as well as one which wipes the viscous material from the shaft during reciprocating of the caulking tube.

Figure 4:
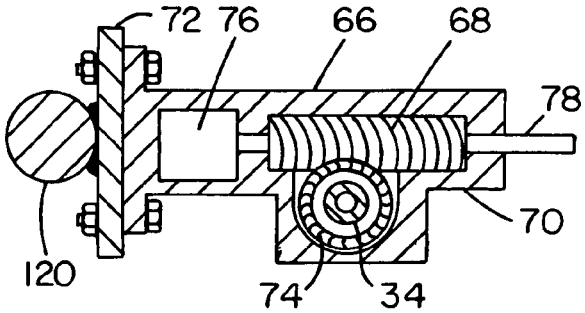
FIG. 4 is a top view of one useful type of worm gear transmission power means for driving the mixing shaft means taken along line 4-4 of FIG. 2, with the gear housing top removed for clarity.
Figure 5:
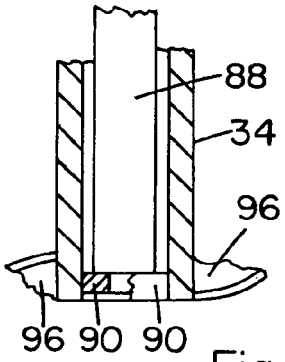
FIG. 5 is an enlarged, for clarity, distal end portion of the mixing blade means and colorant injector piston of FIG. 2.
Figure 8:
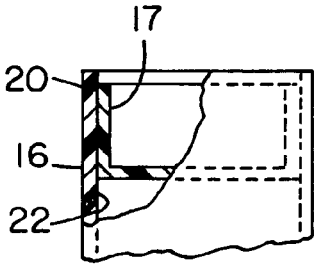
FIG. 8 is a view of the filler end of a typical off-the-shelf caulking compound tube such as DAP® with portions broken away to show the thrust cap in place and which, when pressured further into the tube (down in FIG. 8) by a caulking gun, forces the compound out thru the dispenser nozzle of the tube.

The upper or proximal end 34 of the shaft preferably is mounted thru a rotative power means 44 which can rotate the shaft 32 selectively and substantially instantly in either direction and at any desired rpm, e.g. 600-800 rpm, such that maximum mixing turbulence can be imparted to the work material. One preferred power means is shown in FIG. 4 as a worm gear transmission 66 having a worm shaft 68 rotatably mounted in a housing 70 affixed to a base or frame means 72 of any desired construction which supports the structural components of the present apparatus. Shaft 32 is affixed to a worm gear 74 which mates with shaft 68 and is rotatable thereby. Shaft 68 may be driven by an electric motor 76, preferably variable speed, or by, e.g., reversible electric hand held drill or the like, either house current or battery powered, with its chuck coupled to shaft extension 78, or by a hand crank coupled to 78, all such shaft rotating means being termed herein as power means.

The outermost end 80 of shaft 32 preferably is funnel shaped for facilitating the loading of colorant into passage 82 which is generally axially provided thru shaft 32 and exits thru the inner end 84 of 32. A colorant injection piston rod 88 and annular seal ring 90 affixed to the inner end portion 92 thereof is slidable down into passage 82 and may be employed to forcibly eject colorant which has been loaded into passage 82, into the work material. Rod 88 is preferably provided with a stop means such as collar 94 affixed thereto to allow ring 90 to substantially completely wipe passage 82 clear of colorant but not to allow 90 to pass beyond end 84 of 32 and become damaged. Shaft portion 34 is preferably split and provided with a socket 35 and set screw 37 to allow removal of the shaft from 44 for facilitating cleaning or replacement with a different size impeller blade means 38 and seal means 24.

Figure 6:
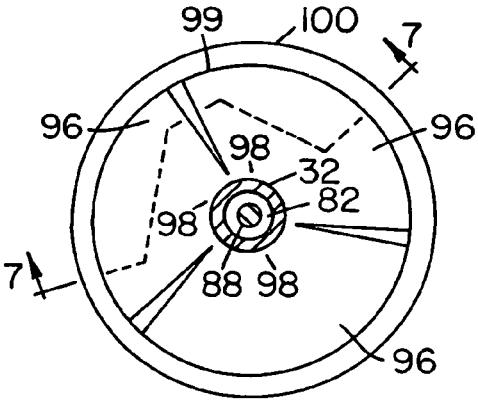
FIG. 6 is a cross-sectional view taken along line 6-6 of FIG. 2 in the direction of the arrows and showing the mixer blade means.
Figure 7:
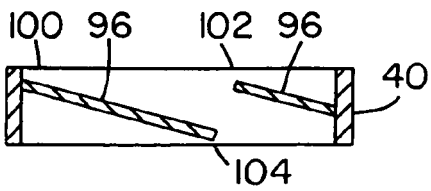
FIG. 7 is a cross-sectional view taken along line 7-7 in FIG. 6 in the direction of the arrows.
Figure 10:
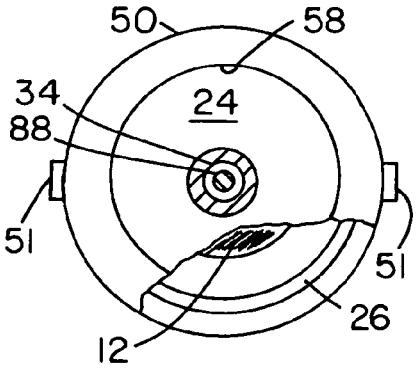
FIG. 10 is a view of the mixer head means taken along line 10-10 of FIG. 2 in the direction of the arrows with portions broken away for clarity.

The mixer impeller or blade means 38 preferably has multiple, e.g., 2-5 blades 96 of any desired shape such as shown in FIGS. 6 and 7 and having their radially inner portions 98 affixed to shaft means 32 and their outer radial portions 99 affixed to cylindrical rim 100. This rim provides peripheral surface 40 which functions to smoothly slide on inner surface 22 of the tube rotationally and linearly to stabilize 32 and 38 and to wipe surface 22 of compound and colorant during the mixing operation. Rim 100 preferably extends slightly above the blades 96 at their upper portions 102 and slightly below the blades at their lower portions 104 such that at the ends of the reciprocation travel, rim 100 will, in the event said travel is slightly unintentionally over extended, engage dispensing end 18 or seal means 24 before the rotating blades can make contact with either or both of 18 or 24 and cause damage thereto or to the blades. It is noted that end 18 is typically of thin plastic such that an operator can easily puncture it with a nail or the like pushed thru the opened nozzle tip 106 when ready for use.

Figure 3:
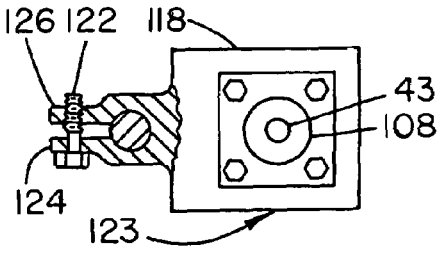
FIG. 3 is a view taken along line 3-3 of FIG. 1 in the direction of the arrows with portions broken away for clarity.

Referring to FIGS. 1-3, the power or lift means 42 preferably is the piston 43 and an automatically two way operating hydraulic or air cylinder 108, and is connected to the base 110 of the holder 46 preferably by a quick disconnect coupling such as pin 112 and socket 114. Compression spring 116 urges pin 112 into 114. Such a coupling allows a quick change of holder 46 to accommodate tubes: of different sizes.

In this embodiment, cylinder 108 is mounted on a foot member 118 which is clamped to a stanchion 120 of base or frame means 72 by bolt means 122 slidable thru an aperture in leg 124 and threaded thru a threaded aperture in leg 126. When 122 is loosened, member 118 and attached cylinder 108 and holder 46 can be rotated to the side to allow easy removal or loading of a tube in holder 46. Member 118 can also be slid up or down on stanchion 120 to position holder 46 in the precise vertical position to receive a tube. In this regard, ruler markings 128 can be provided on the stanchion to make easier the proper vertical positioning of 118 for each size tube.

It is apparent that for this embodiment, where tubes of different lengths are used, the travel of piston 43 must be adjusted to give the proper reciprocating stroke length to holder 46, relative to the vertically stationary mixer impeller 38. For this purpose, a cylinder 108 is selected which can readily give the maximum piston stroke required for the longest retail caulking tube which might be used by tradesmen. At the time of this writing about 12 to 14 inches of piston stroke would appear to be more than is needed for the most common reservoir length of retailed tubes of caulking material.

In order to adjust and control the piston stroke length and direction, electrical limit switches 130 and 132 vertically adjustably mounted on frame 72 are adapted to engage their arms 131 and 133 respectively with the bottom 134 and top 136 respectively of holder 46 at the prescribed limits of its reciprocation and, by means of solenoid valves in the hydraulic or air system which are electrically connected to the switches, reverse the direction of hydraulic or air fluid flow and the direction of the piston stroke. Control means are also provided to adjust the speed of the piston reciprocation. In practice, a stroke speed of from about 4 to about 20 seconds per complete up-and-down cycle is desirable, but slower or faster speeds may, of course, be used.

In the operation of the apparatus, a holder 46 of proper dimensions for receiving a particular size caulking tube is connected to piston 43. Foot member 118 is vertically adjusted on stanchion 120 to vertically position the holder where the piston stroke can accommodate the required full up-and-down travel of the holder with room to spare such that impeller 38 can be extracted from the tube after mixing is complete. The limit switches 130, 132 are then vertically adjusted on stanchion 120 of frame 72 and locked into position for being actuated by the bottom and top alternately of the holder at the precise moment that impeller 38 is at the prescribed ends of its reciprocation stroke or travel. The device is now ready to receive a caulking tube 16 from which a thrust cap seal 17 has been removed by, e.g., applying pressure to the tube sides which pops 17 out of the tube.

In order to facilitate vertical loading of the tube into the holder and removing it therefrom, the foot member 118, after loosening bolt 122, is swung to the side 123 such that the holder and tube can clear impeller 38 and any other structure of the device which might be in the way. When it is desirable to maintain the precise vertical position of 118 such as when the device is needed to mix several tubes of the same size, a positioning collar 140 as shown by dotted line in FIG. 1 may be employed to support 118 while it is being rotated.

Figure 9:
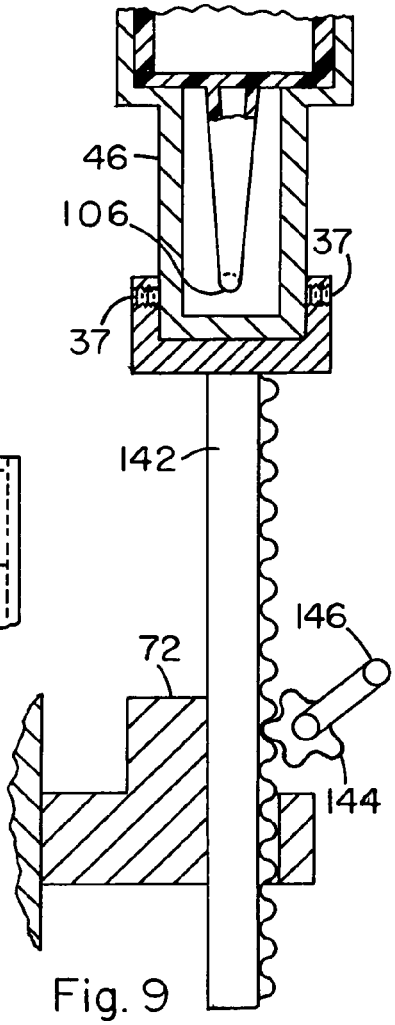
FIG. 9 is a side view, partially sectioned, of a rack and pinion type power means for reciprocating the tube.

As shown in FIG. 9 other types of reciprocating power means may be employed such as rack 142 and pinion gear 144 wherein 144 may be driven by reversible motor means and the travel of 142 controlled by switches such as 130 and 132. Gear 144 may also be fitted within a hand crank 146 if desired.

In the embodiment of FIG. 11, the colorant fluid may be contained in a syringe 148 and a plastic tube 149 provided and connecting the syringe nozzle 150 to a pipe 152 fixed thru the seal body 56. The syringe can be used to inject colorant into the tube before the mixing starts or during the mixing, or both.

In a related embodiment, tube 149 may be rigid or semi-rigid plastic, or metal or ceramic and used, e.g., by inserting it down into the open caulk tube and substantially all the way thru the work material, and the syringe then actuated to inject the colorant into the material as tube 149 is slowly withdrawn therefrom to leave a column of colorant longitudinally in the material. The mixer head means 23 may then be fixed into the open tube end by, e.g., the mechanism of FIG. 13, and the mixing process started by any power means such as a hand drill chucked directly onto shaft portion 34.

It is noted that the configuration of the head means 23, the seal means 24 and the pressure cap means 41 can be varied in accordance with the present invention, such as, for example those shown in FIGS. 2, 11-15 and 20. In FIG. 2, cap section 50 is provided with two or more spring arms 51 which are formed with shoulders 53 adapted to snap in under a shoulder ring 55 affixed around holder 46 as cap section 50: is pushed down over the open neck of the holder with sufficient force to compress seal 62 to a sealing condition. These arms 51 are readily removed from 55 by an outward pull on their lower ends.

In FIG. 11, cap section 50 and the holder section 46 are provided with mating threads 52 such that adequate sealing pressure can be applied to 62 by a small rotating force applied to the cap. Cap section 50 is preferably knurled as at 47 for allowing hand tightening.

In FIG. 1.2 the seal means 24 comprises an elastomeric gripping body 160 having a circular periphery 162 which is dimensioned in diameter to slide down into the filler end 20 of a caulking tube. A bushing 164 having threads or first shoulder means 165 is axially mounted thru bore 28 in body 160 and has its inner distal end 161 non-rotatably fixed to a plate or second shoulder means 166 as by welding at 167 or integrally machined or otherwise formed on the bushing as in FIG. 31. Shaft 32 is rotatably, slidably mounted thru a bore 168 in the bushing. A washer 170 preferably of low friction metal or plastic material is mounted over the bushing and a nut 172 is threaded over the bushing. The upper end 171 of bushing 164 extends an exaggerated amount above nut 172 to provide wrench flats 173 for holding 164 and body 160 from rotating as nut 172 is tightened against washer 170.

In use, shaft 32 is mounted thru bore 168 with the mixer impeller lying adjacent plate or second shoulder means 166. With the mixer impeller then inserted into a tube thru the tube filler end thereof, body 160 is slid into the filler end to a desired position therein. A wrench is then mounted on flats 173 to hold bushing 164 and washer 166 stationary, and nut 172 is tightened sufficiently to bulge the body 160 radially outwardly to seal and grip against inner surface 22 of the caulking tube. The elastomeric material of body 160 is selected to allow it to sealingly bulge under just a few pounds of pressure from the tightening nut 172.

With the seal means 24 and mixer impeller means thus positioned in the tube, and with the colorant injected, e.g., deposited in the tube, on or into the work material by drop bottles, syringe, spatula, gel capsules, color packets, mechanical dispenser, or the like, the tube can be hand held or placed within a holder or carriage 77, and the shaft 32 rotated either by a power means such as 44 or, e.g., an electric drill having its chuck fixed to 32. Reciprocation of the mixer head thru the work material relative to the caulking tube can be done by power means such as 42 or by hand.

Figure 12:
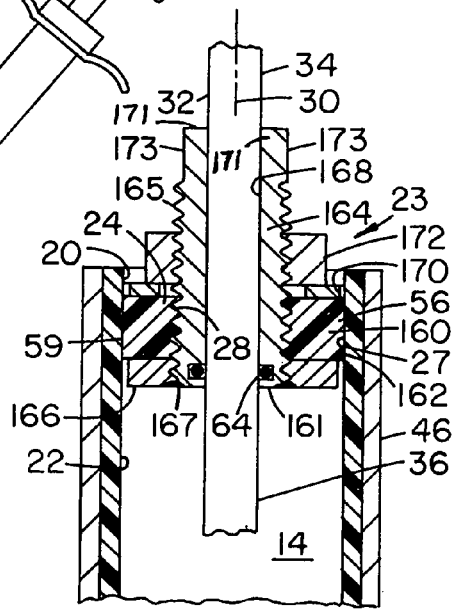
FIG. 12 is a cross-sectional view of the proximal end of the tube and a variation of the mixing head means including a tube holder section.
Figure 13:
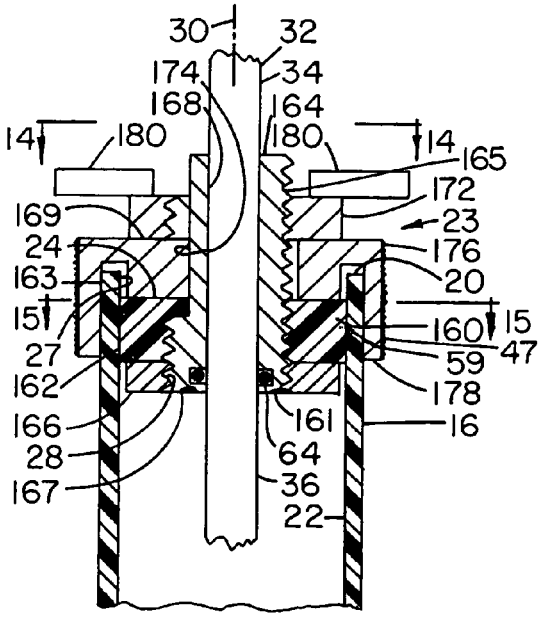
FIG. 13 is a view as in FIG. 12 showing a more preferred type of mixer head means.
Figure 14:
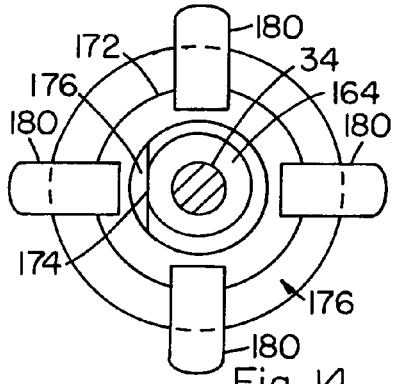
FIG. 14 is a top view of the head means of FIG. 13 taken along line 14-14 thereof in the direction of the arrows.
Figure 15:
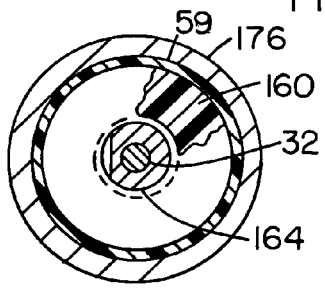
FIG. 15 is a cross-sectional view taken along line 15-15 of FIG. 13 in the direction of the arrows.

Referring to FIGS. 13, 14 and 15 wherein structure substantially equivalent to that of FIG. 12 are numbered the same, bushing 164 is provided with a flat 174 over which a pressure cap 176 of special configuration is mounted. This cap is dimensioned and shaped to slide down over bushing 164 and the open neck 163 of a tube and be held by hand from rotating while nut 172 is tightened against the upper surface 169 of the cap to bulge seal body 160 as at 59. The outer cylindrical wall 178 of the cap prevents excessive outward bulging of the tube neck wherein such bulging might be a problem for some tubes having thin or weak walls. Torque arms 180 on nut 172 allow hand tightening thereof.

Referring to FIGS. 16-31, the best modes presently known for practicing the present invention are shown therein and wherein certain structures are numbered as in FIGS. 1-15.

In the embodiments of FIGS. 16 thru 31, the tube 16 is locked to head means 23 in a manner similar to FIGS. 12 and 13. Referring to FIG. 20, head 23 comprises pressure cap means 41 formed to provide a wall 57 dimensioned to provide a tube receiving cavity 177 for snugly, slidably receiving the filler end 20 of tube 16. The elastomeric body 56 of seal means 24 is substantially cylindrical in shape having a substantially uniform diameter periphery 186 in its uncompressed condition but is bulged laterally as shown at 59 in its compressed sealing condition wherein the upper portion 27 of the tube 16 is pressured against the bulge 59 to lock the tube to the head means 23.

Head means 23 further comprises a bushing such as 164 but having a substantially oblong cross-section stem 73 threaded as at 165 and having flats 61 for preventing rotation of the bushing in the mating and substantially oblong bushing bore or aperture 65 provided thru the top 67 of cap means 41 and thin which the bushing can longitudinally slide. A circular tightening knob 69 having internal threads 71 is adapted to be threaded onto bushing 164 and tightened against proximal pressure surface 159 of cap top 67 such that the pressure plate portion or second shoulder means 166 of the bushing and distal pressure surface 175 of top 67 will compress body 56 between its top 182 and bottom 184 surfaces and bulge it radially to frictionally lock against the inner wall surface 188 of the tube and seal the tube between body 56 and recess wall 57. It is noted that body 56 may have various cross-sectional configurations and constructions such as the elastomeric, resilient air filled doughnut 75 shown in a compressed operational condition in FIG. 27.

Figure 16:
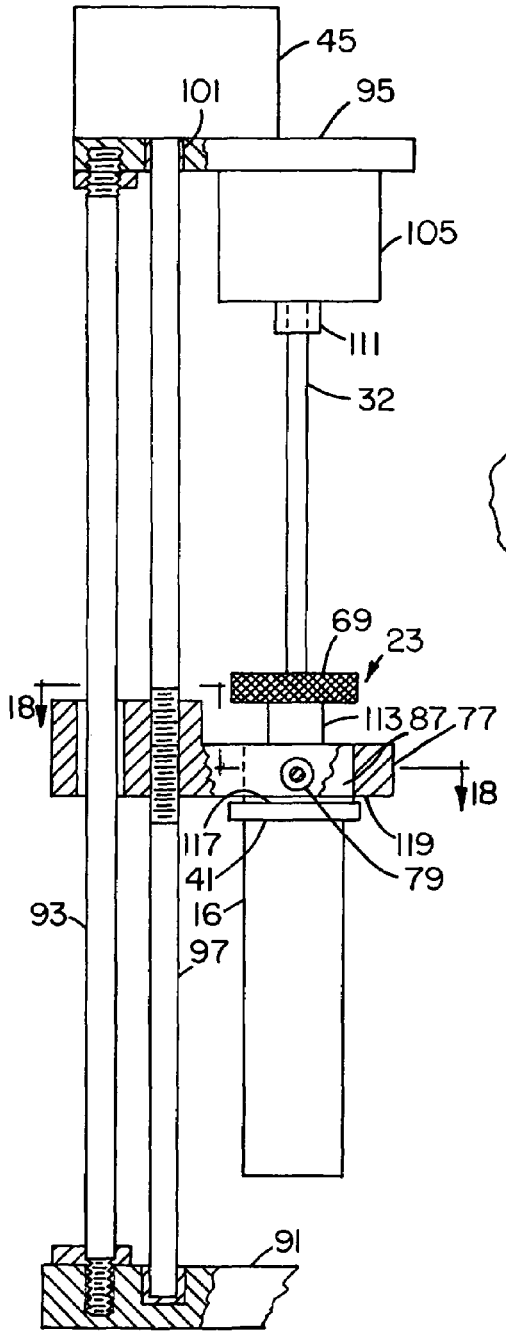
FIG. 16 is a partially sectioned side elevation view of an electrical motor powered reciprocation apparatus with the present preferred mixing head structure mounted on a carriage means.

As shown in FIG. 16 head means 23 with the tube 16 locked thereto is removably affixed to a carriage means 77 of any desired configuration and preferably provided with a retractable positioning pin 79 or equivalent which is adapted to fit within a recess 81 in the wall portion 87 of cap 41 (see FIG. 20) to removably lock head 23 and tube 16 to the carriage 77 in a desired position. Compression spring 83 is compressed between a plug 85 threaded into 77 and a shoulder 86 affixed to pin 79 to continually urge the pin toward an aperture 89 in the carriage, in which aperture the cap 41 is to be locked as hereinafter described.

Figure 17:
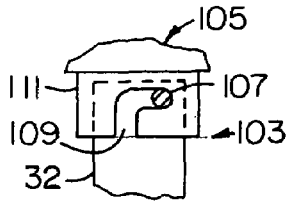
FIG. 17 is an elevation view of a useful means for quickly connecting the mixer shaft to a rotative power source.
Figure 18:
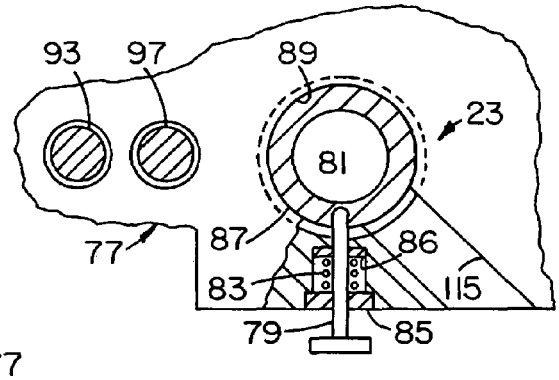
FIG. 18 is a view taken generally along line 18-18 of FIG. 16 in the direction of the arrows.

In FIG. 16 an apparatus is shown for reciprocating the carriage 77 and tube and comprises a base 91 to which is affixed a stanchion 93 which is slidably mounted thru the carriage and supports at its upper end a header means 95. A threaded spindle 97 is rotatably mounted on base 91 and is threaded thru the carriage and rotatably passes thru a bearing 101 in 95. An electric motor 45 or equivalent is mounted on 95 and its output shaft is connected to spindle 97. This motor is preferably adapted to rotate the spindle at any desired speed and to reverse its rotational direction in order to cycle the carriage and tube up and down at a rate to achieve good mixing. Another electric motor 105 or equivalent is mounted on 95 and is adapted for connection to shaft 32 by a bayonet type connector 103 or equivalent as shown in FIG. 17 wherein pin 107 is on shaft 32 and slot 109 is on the output shaft 111 of the motor.

The assembly of the head 23 on the carriage 77 with tube attached in operating condition with shaft 32 extending outwardly a desired extent is carried out by positioning the neck portion 113 of the head into channel 115 in the carriage, pulling pin 79 outwardly from aperture 89, moving 113 inwardly until wall portion 87 is laterally within the perimeter of aperture 89, thrusting the head upwardly until shoulder 117 thereon abuts the underside 119 of the carriage, releasing pin 79 to allow it to engage against wall portions 87, and rotating the head until the pin automatically inserts into recess 81 by way of spring 83. At this point the shaft 32 can be extended upwardly by the operators hand force to make the connection shown in FIG. 17. It is noted that where reverse rotation of shaft 32 is desired, a type of connector other than 103 should be used such as, e.g., a set screw. The length of stroke of the carriage is preferably regulated by limit switches or the equivalent in the manner shown in FIGS. 1 and 2. Other types of regulatory means such as light or other radiation sensing devices may, or course, be employed.

It is noted that for any of the embodiments shown herein the head 23, carriage 77 and tube 16 may be held stationary while the shaft 32 and motor 105 are reciprocated. Such a variation is readily made, for example, by attaching the carriage 77 in fixed position on a lower portion of stanchion 93 and disconnecting it from spindle 97, and removing motor 105 from header 95 and affixing it to a carriage such as 77 as the carriage and its mounting are shown in FIG. 16.

Figure 19:
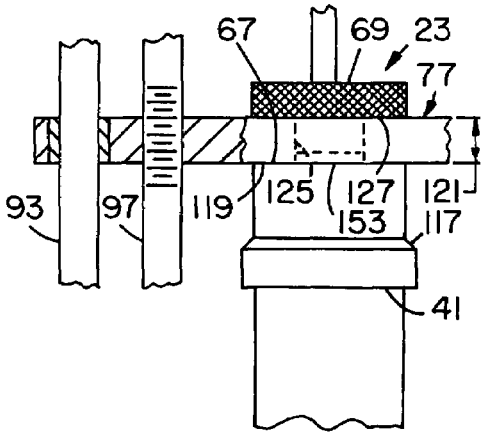
FIG. 19 is a view as in FIG. 16 of a variation in the connection of the carriage means to the mixer head means.
Figure 20:
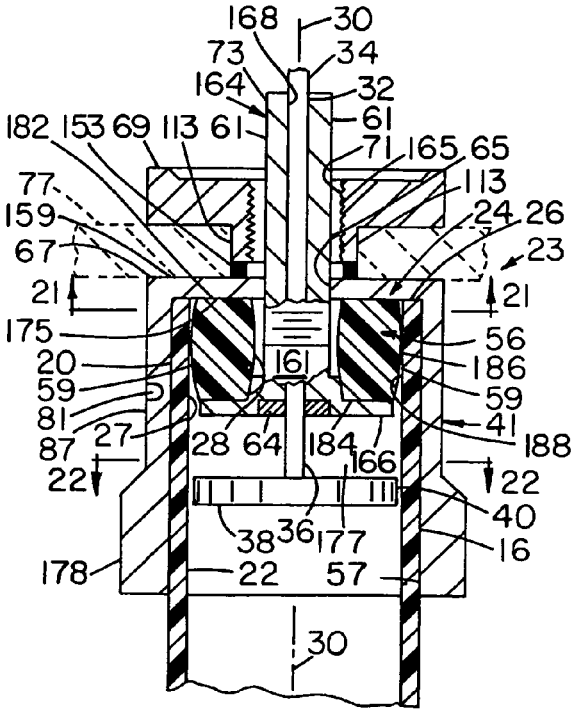
FIG. 20 is a longitudinal cross-section of a preferred head means.
Figure 20A:
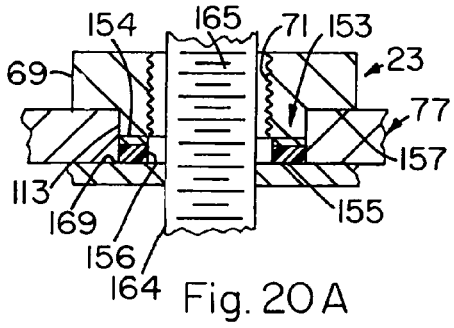
FIG. 20A is an enlarged cross sectional view of the portion of head 23 which clamps onto carriage 77.
Figure 21:
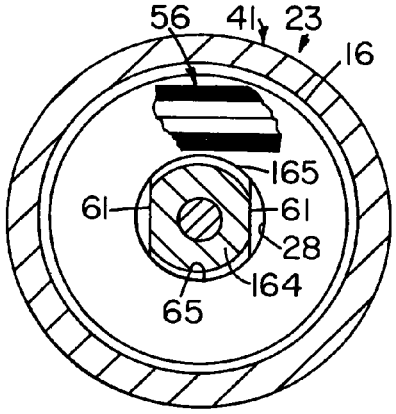
FIG. 21 is a cross-sectional view taken along line 21-21 of FIG. 20 in the direction of the arrows and showing only a portion of body 56 in elastomeric cross-section.

Referring to FIG. 19, the phantom lines of 77 in FIG. 20, and to FIG. 20A the assembly of head 23 with carriage 77 can be done by way of (1) making the aperture 89 of a diameter approximately the same as the width of channel 115 which preferably is only slightly wider than the diameter of neck 113 of the tightening knob 69, (2) dimensioning the head components and the thickness 121 of the carriage such that with the tube 16 clamped by an initial force to the head, the neck 113 can be slid thru channel 115 to aperture 89 and the knob 69 then further tightened a small but sufficient degree to clamp the carriage between the underside 127 of the knob and the top 67 of the pressure cap 41, and (3) employing a compressible pressure element such as 153 comprised of an annular metal washer component 154 and an annular elastomeric buffer component 155 wherein bushing 164 is slidable thru the center opening 156 of said element and wherein said buffer component is less compressible than body 56 such that seal body 56 will bulge tightly at 59 against the tube wall before said buffer component compresses to the point where the underside 157 of knob 69 tightly engages carriage 77. It is preferred that 154 and 155 be adhesively affixed to each other and that 156 be adhesively affixed to the top 67 of pressure cap means 41.

Figure 23:
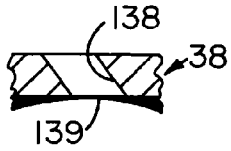
FIG. 23 is a cross-sectional view of the impeller taken along line 23-23 in FIG. 22 in the direction of the arrows.
Figure 22:
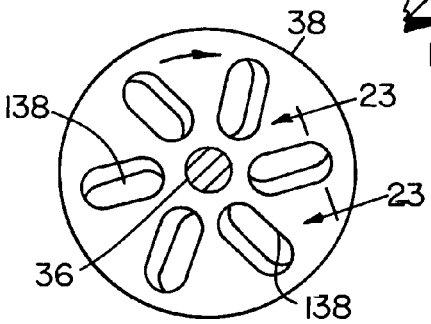
FIG. 22 is a view of a highly preferred impeller taken along line 22-22 in FIG. 20 in the direction of the arrows.
Figure 24:
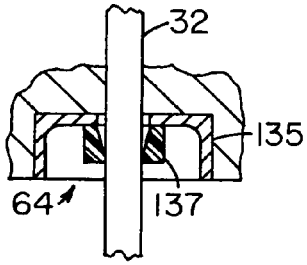
FIG. 24 is a cross-sectional view of a preferred shaft seal mounted in the bushing.
Figure 25:
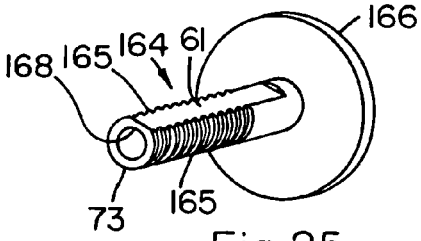
FIG. 25 is a perspective view of the bushing of FIG. 20.

The most preferred shaft seal 64 is shown in FIG. 24 wherein an annular metal housing 135 is adhesively affixed to an annular or ring seal 137 of elastomeric material. The most preferred impeller 38 is disc shaped as shown in FIGS. 22 and 23 wherein the mixing blades are in the form of slots 138 tapered from about 30 to about 50 degrees, and wherein the direction of rotation of shaft 32 is clockwise. The construction greatly reduces the whipping of air into the caulk mass during mixing. The bottom 139 of the impeller disc is slightly concaved such that the tube seal 141 will not be damaged if the impeller comes into contact with the tube bottom.

Figure 26:
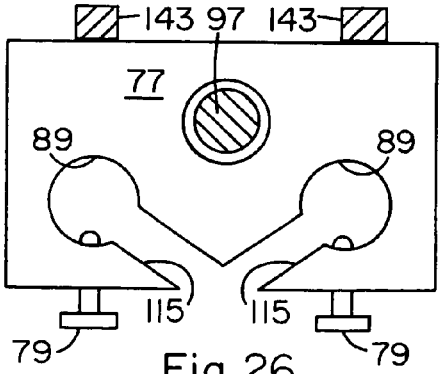
FIG. 26 is a top view of a multiple head carrying carriage.
Figure 27:
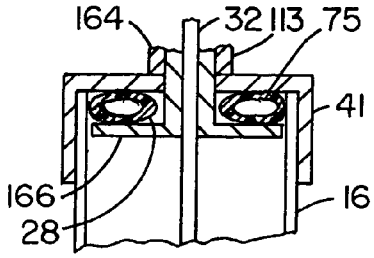
FIG. 27 is a partial view of the head means of FIG. 20 and showing a variation in the structure of seal body 56.
Figure 29:
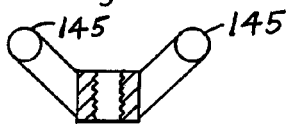
FIG. 29 shows in an alternative tightening means structure for knob means 69 in FIG. 20.

As shown in FIG. 26 multiple channels 115 and apertures 89 may be provided in the carriage 77 for simultaneous multiple mixings. Stanchion slide guides such as 143 against which the carriage is vertically slidable may be provided to prevent rotation of the carriage during mixing. In FIG. 29 an alternative to knob 69 is shown as a pair of opposed arms having smooth hemispherical ends 145 for easy gripping and rotation.

Figure 28:
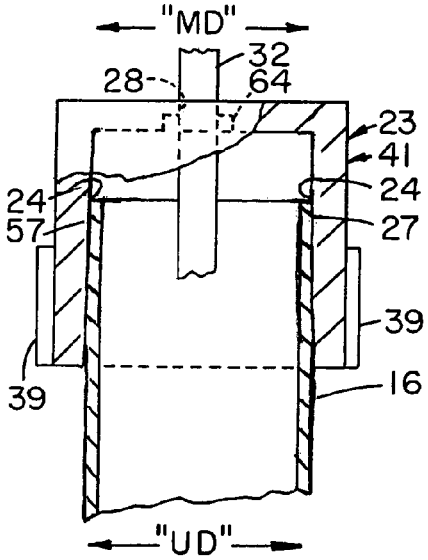
FIG. 28 shows a variation in mixing head structure.
Figure 30:
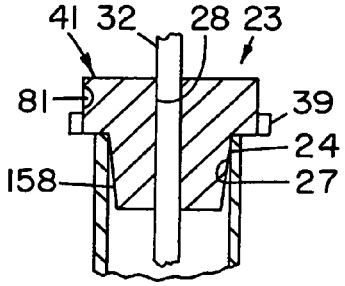
FIG. 30 is a cross-sectional view of a variation of the tapered seal construction of FIG. 28 wherein inner portions of the tube filler end wall provide a component of the seal.

Referring to FIG. 28, the seal means 24 comprises a slightly tapered, e.g., 1-5 degrees cylindrical recess wall 57 into which the open filler end of tube 16 is pushed. The frictional contact of the tube with wall 57 is sufficient to seal the tube end and stabilize the shaft 32 axis and impeller within the tube such that rotation and reciprocation of the shaft can proceed smoothly without dislocation of the head 23 from the tube. In FIG. 30 the tapered wall 158 provides the seal and frictional lock of the head to the tube.

For these embodiments which afford quick and easy on-the-job mixing, the cap 41 is preferably provided with ridge projections 39 spaced around the cap for gripping such that in addition to pushing or pulling the tube, rotation of the cap on the tube can be facilitated to ensure proper sealing and to assist in removal of the tube from the head. Also for this embodiment the rotative power means preferably comprises a hand or palm held and small size battery operated electrical motor with its output shaft integral with shaft 32 such that all of the structures of head means 23 desired for convenient and expeditious mixing are integrated into a single hand held unit falling within the ambit of "combination" as used herein.

Figure 31:
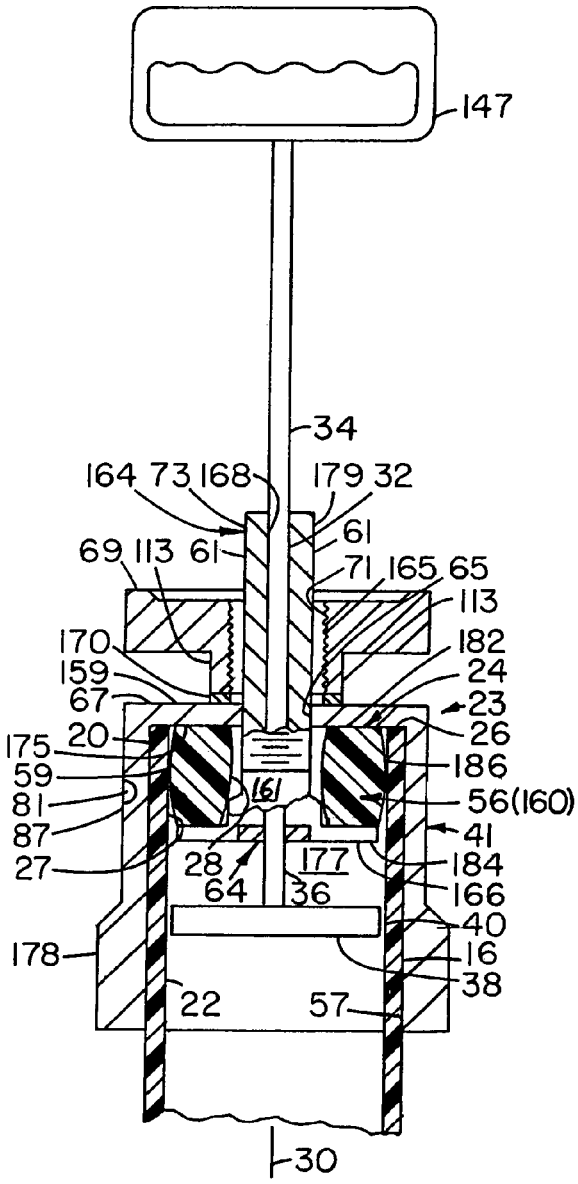
FIG. 31 is essentially the same as FIG. 20 but wherein the shaft is provided with a handle for non-rotative mixing.

In another and highly preferred embodiment of the present invention, particularly the fully hand held and hand operated version as shown in FIG. 31, shaft 32 is provided with a handle 147 by which the operator can reciprocate shaft 32 and impeller 38 without having to rotate the shaft and impeller to intimately mix the caulk and colorant. It is preferred that for this operation, after the colorant is added thru the open top of tube 16, the following procedure is followed:

1. Insert shaft 32 and impeller 38 all the way down into the tube thru the caulk wherein 38 is proximate dispensing end 18 of the tube;
2. Position and tighten head means 23 in the tube fill end to seal the tube whereby the pressure within the tube is ambient;
3. Withdraw the shaft and impeller to proximate the tube fill end whereby the pressure within the tube becomes less than ambient, e.g., 7-10 psi., and whereby air which was originally entrained within the caulk now tends to escape therefrom; and 4. Reciprocating, e.g., 10-50 times, the shaft and impeller within the tube between said fill end and said dispensing end whereby the pressure within said tube cycles between ambient, e.g., 14.7 psi., and less than ambient, e.g., 7-10 psi and whereby said colorant is intimately mixed into the caulk.

It is apparent, of course, that the above procedure can be carried out by the use of automatic or semi-automatic type reciprocating equipment such as that shown in FIG. 16 but without the need for a motor 104, wherein the outer end of shaft 32 simply could be clamped in a non-rotative position on stanchion 93 during the mixing operation.

It is noted that the head variations of FIGS. 28, 30 and 31 may be provided with means for mounting them on carriage 77 such as recess 81 formed in the sides thereof for receiving a pin such as 79.

In order for the preferred and best mode embodiments of the present invention to work properly and to produce the most convenient and expeditious mixing results, the pressure cap means 41 must be so constructed that it does not interfere with or impede the operators hand gripping of the tube 16 as the operator is assembling or disassembling the head 23 and tube and, if desired, as the operator is holding the tube during the mixing operation. To this end and with the cap affixed to the tube, the downwardly depending wall 178 or other portions of the pressure cap should allow at least about a hands width of at least about four inches of the tube dispensing end 18 to protrude beyond wall 178. Therefore, it is preferred that a total length of the cylindrical recess wall 57 of pressure cap means 41 does not exceed three inches even where a reciprocating apparatus as shown in FIG. 16 is employed since proper placement of the head and tube in the carriage means 77 is greatly facilitated where the operator can hand grip the tube. It is noted that an experienced operator by hand gripping a tube 16 can remove thrust cap seal 17, feed additive thru the tube filler end 20, assemble the head 23 onto the filler end 20, run and/or reciprocate the shaft 32 and impeller 38 to mix the components, remove the head from the tube, and replace seal 17 in the tube in less than 30 seconds, particularly when the combination is only hand supported during the mixing operation.

The invention has been described in detail with particular reference to preferred embodiments thereof, but it will be understood that variations and modifications will be effected with the spirit and scope of the invention.

I claim:

1. A mixing method employing a tube of viscous material wherein the tube has a sealed dispenser end section, a filler end section having surface portions defining a fill opening into the tube, and a thrust cap slidably mounted in said filler end section, said method further employing a mixing apparatus having a mixer seal structure adapted to seal and frictionally lock against surface portions of said filler end section during the mixing operation, wherein a mixer shaft is slidably sealingly mounted thru an axial bore in said seal, and wherein a mixer impeller is fixed to a distal end portion of said shaft for movement therewith said tube, said method comprising performing the steps of (a) removing said thrust cap from said tube, (b) adding colorant into contact with said material within said tube, (c) placing said mixer seal sealingly against said surface portions of said open filler end section to seal said fill opening with said impeller inside of said tube, (d) starting reciprocation of said shaft within said tube (e) continuing the reciprocation for a desired mixing period, (f) removing said seal, shaft and impeller from said tube and from the now colored material therein, and (g) replacing said thrust cap in said filler end section to retain the colored material in said tube.

2. The method of claim 1 wherein in carrying out step (c) the impeller is positioned within the lower portion of the tube before the tube is sealed whereby the portion of the shaft which is within the tube, when withdrawn from the tube during the reciprocation of step (d), will cause a reduction in pressure within the tube and thereby result in deaeration of said material.

3. The method of claim 1 wherein said material is conventional caulk and said colorant is a portion of paint, the color of which is to be imparted to said caulk, wherein said portion is selected in quantity adequate to properly color said caulk.

* * * * *